US011338184B2

(12) United States Patent
Hamilton et al.

(10) Patent No.: US 11,338,184 B2
(45) Date of Patent: May 24, 2022

(54) GOLF GAME

(71) Applicants: Alan L. Hamilton, Indianola, IA (US); Lesa D. Hamilton, Indianola, IA (US)

(72) Inventors: Alan L. Hamilton, Indianola, IA (US); Lesa D. Hamilton, Indianola, IA (US)

( * ) Notice: Subject to any disclaimer, the term of this patent is extended or adjusted under 35 U.S.C. 154(b) by 0 days.

(21) Appl. No.: 16/226,880

(22) Filed: Dec. 20, 2018

(65) Prior Publication Data

US 2019/0184254 A1 Jun. 20, 2019

Related U.S. Application Data

(60) Provisional application No. 62/608,193, filed on Dec. 20, 2017.

(51) Int. Cl.
*A63B 67/02* (2006.01)

(52) U.S. Cl.
CPC ..... *A63B 67/02* (2013.01)

(58) Field of Classification Search
CPC ..... A63B 67/02; A63B 67/04; A63B 67/14; A63B 67/00; A63B 71/02; A63B 71/04
USPC ..... 273/108, 118 R, 126 R
See application file for complete search history.

(56) References Cited

U.S. PATENT DOCUMENTS 2,025,183 A * 12/1935 Stayton ..... A63B 67/02 473/162
3,464,704 A * 9/1969 Nelson ..... A63B 67/02 473/162
3,584,877 A * 6/1971 Florian ..... A63B 67/02 473/159
3,669,454 A * 6/1972 Kolonel ..... A63B 67/02 473/162
3,727,918 A * 4/1973 Zawacki ..... A63B 67/02 473/159
3,772,841 A * 11/1973 Barak ..... A63B 57/40 52/741.1
3,885,795 A * 5/1975 Brewer ..... A63B 67/02 473/165
3,892,412 A * 7/1975 Koo ..... A63B 67/02 473/160
4,203,604 A * 5/1980 La Grange ..... A63B 69/3661 273/DIG. 13
4,323,250 A * 4/1982 Lansberry ..... A63D 3/00 273/400
4,647,046 A * 3/1987 Hurt ..... A63B 67/02 473/162
4,957,288 A * 9/1990 Kantner ..... A63B 67/02 473/159
5,116,048 A * 5/1992 Bilocerkowycz ..... A63B 67/02 273/108.21
5,201,521 A * 4/1993 Healy ..... A63B 67/02 473/160
5,261,670 A * 11/1993 Mull ..... A63B 69/3676 473/164
D385,007 S * 10/1997 Perrin ..... A63B 67/02 D21/792

(Continued)

*Primary Examiner* — Raleigh W Chiu
(74) *Attorney, Agent, or Firm* — Zarley Law Firm P.L.C.

(57) ABSTRACT

A golf game having an elongated mat with a first end, a second end, sides, a top surface, and a bottom surface. Adjacent each end are a plurality of holes with each hole having a removable plug. Along the sides, the first end, and the second end are rails that preferably fold up from the edges of the mat by remaining interconnected by male/female slots.

10 Claims, 2 Drawing Sheets

(56) References Cited

U.S. PATENT DOCUMENTS 5,738,594 A * 4/1998 Kinney ..... A63B 67/02 473/162
5,863,256 A * 1/1999 MacLean ..... A63B 67/02 473/160
6,413,166 B1 * 7/2002 Long ..... A63B 67/02 473/160
7,255,648 B1 * 8/2007 Romeo ..... A63B 57/357 473/180
D632,749 S * 2/2011 Montgomery ..... A63B 67/02 D21/791
8,702,528 B1 * 4/2014 Montgomery ..... A63B 67/02 473/150
2002/0103036 A1 * 8/2002 Florian ..... A63B 67/02 473/162
2003/0096657 A1 * 5/2003 Knox ..... A63B 67/02 473/150
2003/0166420 A1 * 9/2003 Chou ..... A63B 67/02 473/151
2003/0190969 A1 * 10/2003 Barlow ..... A63B 67/02 473/157
2005/0209014 A1 * 9/2005 Kim ..... A63B 24/0021 473/157
2006/0040761 A1 * 2/2006 Shin ..... A63B 24/0021 473/278
2007/0042829 A1 * 2/2007 Dennesen ..... A63B 69/3661 473/162
2009/0054170 A1 * 2/2009 Probst ..... A63B 67/02 473/162
2010/0331094 A1 * 12/2010 Graves ..... A63B 57/357 473/179
2013/0116059 A1 * 5/2013 Yeh ..... A63B 67/02 473/160
2014/0329611 A1 * 11/2014 Sanders ..... A63B 67/02 473/160
2017/0021262 A1 * 1/2017 Hayakawa ..... A63B 67/02
2018/0056155 A1 * 3/2018 McAuley ..... A63B 63/08
2018/0056157 A1 * 3/2018 Cohen ..... A63B 63/007
2018/0200596 A1 * 7/2018 Shill ..... A63B 67/02
2019/0184254 A1 * 6/2019 Hamilton ..... A63B 67/02

* cited by examiner

GOLF GAME

CROSS REFERENCE TO RELATED APPLICATIONS

This application claims the benefit of priority from Provisional Application No. 62/608,193 filed Dec. 20, 2017, the contents of this application is hereby incorporated by reference in their entirety.

BACKGROUND OF THE INVENTION

This invention is directed to a golf game and more particularly a golf game played in bars and at tailgates.

Games for bars and tailgating are well-known in the art. These games include, but are not limited to, darts, shuffleboard, corn hole bean bag, and the ladder game. Games related to golf are also known in the art and include devices having an elongated putting surface and a cup. While useful, these devices are not easy to transport, nor are they adapted for both indoor and outdoor use. Further, the extent of the challenge of the game is putting a ball into a single cup. Accordingly, a need exists in the art for a device that addresses these deficiencies.

An objective of the present invention is to provide a golf game that is easy to transport.

Another objective of the present invention is to provide a golf game that can be played both indoor and outdoor.

These and other objectives will be apparent to those having ordinary skill in the art based upon the following written description, drawings, and claims.

SUMMARY OF THE INVENTION

A golf game having an elongated mat comprised of a plurality of interconnecting mat sections that make the mat easy to assemble and transport. The mat has a first end, a second end, sides, a top surface and a bottom surface. The mat sections are connected with a male prong/female slot arrangement. The outer edges of the mat on the sides and ends has a portion that folds upwardly while remaining interconnected to form a rail.

Adjacent each end is at least one and preferably a plurality of holes with each hole having a removable plug. In one example, each end has a top mat section positioned on top of a bottom section. The holes in the bottom section, which align with the holes in the top section have a diameter smaller than the top section to form a shoulder. A layer of material is attached to the bottom surface of the elongated mat.

DETAILED DESCRIPTION

Figure 1:
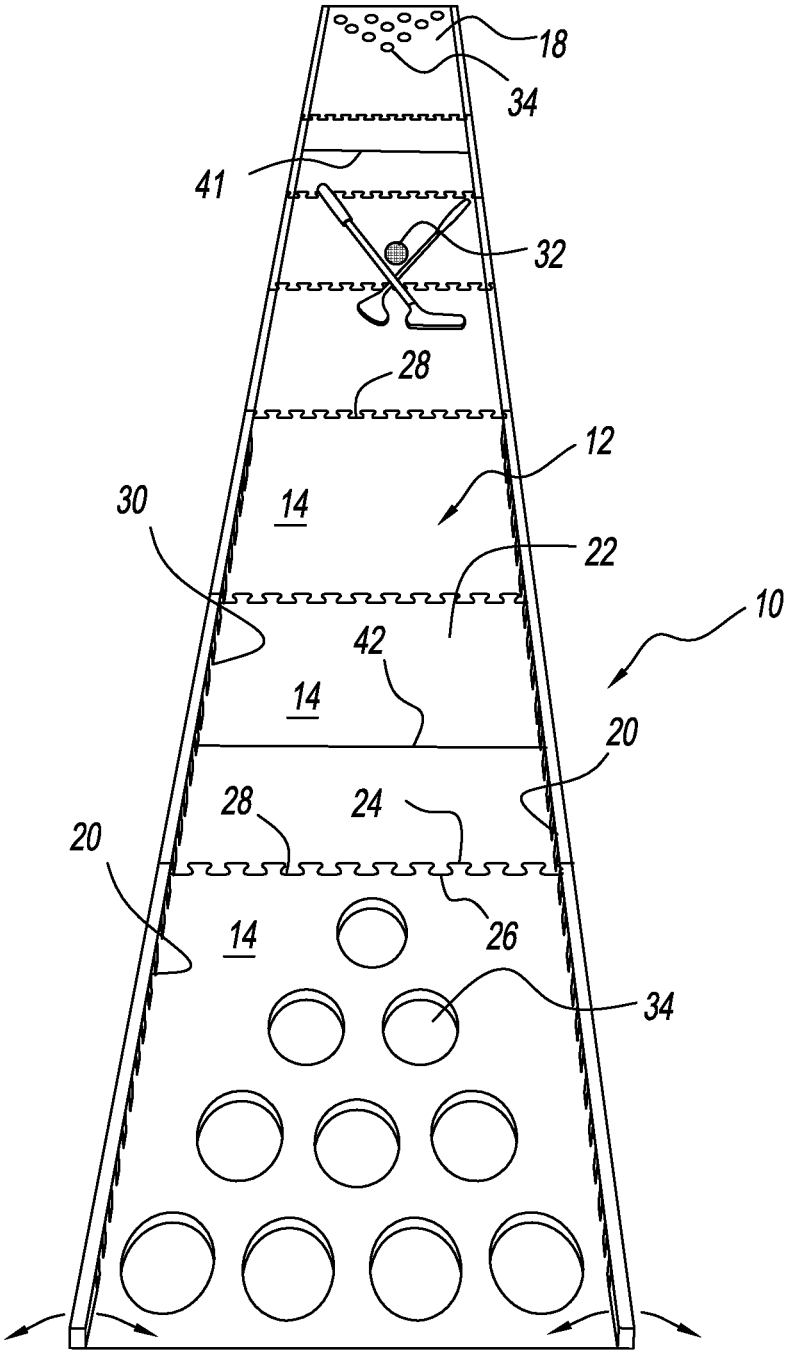
FIG. 1 is a top perspective view of a golf game.
Figure 2:
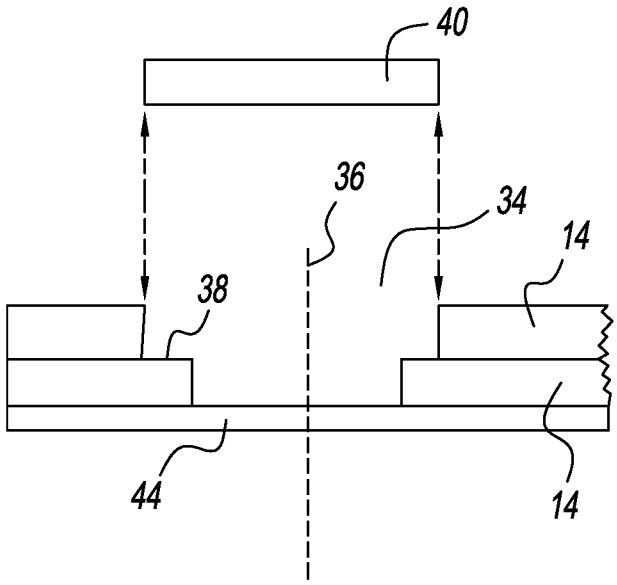
FIG. 2 is a side sectional view of an end of a golf game.

Referring to the Figures, a golf game 10 has an elongated mat 12 preferably made of a plurality of connected mat sections 14. The mat is of any size, shape, and structure and, by example, preferably about a half inch thick and sixteen feet long. The mat 12 has a first end 16, a second end 18, sides 20, a top surface 22 and a bottom surface 24. The mat 12 is made of any material and preferably an EVA foam.

The sections are connected in any manner and, by example, have male prongs and female slots 26 along the outer edges 28 of each section 14 that interconnect. Extending along the sides 20 and at each end 16 and 18 are rails 30 that retain a ball 32 on the top or putting surface 22. The rails 30 are of any size, shape, and structure and in a preferred embodiment are formed by folding the edges 28 upwardly while remaining interconnected to the mat 12.

Adjacent each end 16 and 18, the mat sections 14 have one or more holes 34 that are adapted to receive the ball 32. The number and arrangement of holes 34 is of any sort and in the example shown there are ten holes 34 in a triangular shape similar to the placement of bowling pins.

In a preferred embodiment each end section is comprised of a pair of mat sections 14 placed one on top of the other to provide a thickness of about one inch. Holes 34 having a diameter of about three and a half inches are cut through the lower mat section 14 and holes 34 having a diameter of about four inches are cut through the top mat section 14. The holes 34 in the top mat section 14 and the bottom mat section 14 are aligned about a common center axis 36. Because of the difference in diameters, a shoulder 38 is formed by the bottom mat section 14. The portions cut from the holes 34 of the top mat section 14 are retained as plugs 40 for the holes. Also, adjacent each end mat section 14, placed transversely across the mat is a putting line 42.

Attached the bottom surface 24 of the mat 12 is a layer of material 44 such as carpet or the like. The carpet 44 reduces the bounce of the ball through the holes 34 plus prevents grass from extending through the holes when used outdoors.

While the shape of the assembled mat 12 and the rules for playing the game may vary, in a preferred example, the game is played by connecting the mat sections 14, folding the rails 30 upwardly, and removing the plugs 40. Once set up, one or two players are positioned at each end 16 and 18 of the mat 12. Each player in turn, places a ball 32 behind the putting line 42 and using a putter, putts the ball 32 toward the holes 34 in an attempt to put the ball 34 into an open hole 34.

If the ball 32 stays in a hole 34, the ball 32 is replaced with a plug 40 that rests on the shoulder and fills the hole 34. If the ball 32 does not go in a hole 34 then no plug 40 is placed in a hole 34. This process is repeated until one player or team fills all the holes 34 with plugs 40. If there is a tie, one plug is removed and the players or teams continue to putt until one misses while the other makes the putt.

From the above discussion and accompanying figures and claims it will be appreciated that the golf game 10 offers many advantages over the prior art. It will be appreciated further by those skilled in the art that other various modification could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A golf game, comprising:

an elongated mat having a first end, a second end, sides, a top surface, and a bottom surface;

wherein the elongated mat includes a plurality of mat sections connected together by male prongs and female slots and at the first end and the second end one top mat section is positioned on top of another bottom mat section;

at least one hole positioned adjacent the first end and the second end;

removable plugs disposed within the at least one hole;

wherein the at least one hole includes holes cut through the mat sections positioned at the first and second end where the hole in the top mat section has a diameter greater than the hole in the bottom mat section to form a shoulder on the top surface of the bottom mat section and the plug is formed by the cut through of the top mat section and;

wherein the sides, the first end, and the second end have rails formed by folding edges of the elongated mat upwardly while remaining interconnected to the mat by the male prongs and female slots.

2. The game of claim 1 wherein the sides, the first end, and the second end have rails.

3. The game of claim 2 wherein the rails are formed by folding edges of the elongated mat upwardly while remaining interconnected to the mat.

4. The game the claim 1 wherein the first and second ends include a pair of mat sections placed one on top of the other.

5. The game of claim 1 wherein a layer of carpet is attached to the bottom surface of the elongated mat.

6. The game of claim 1 wherein the plurality of mat sections are foldable.

7. The game of claim 1 wherein attached to the bottom surface of the mat is a layer of material such that the material reduces the bounce of the ball through the holes and grass is prevented from extending through the holes when the game is played outside.

8. The game of claim 1 wherein a putting line extends transversely across the mat.

9. The game of claim 1 wherein the at least one hole includes ten holes positioned in a triangular shape.

10. A golf game, comprising:

an elongated mat having a first end, a second end, sides, a top surface, and a bottom surface;

wherein the elongated mat includes a plurality of mat sections connected together by male prongs and female slots;

at least one hole positioned adjacent the first end and the second end;

removable plugs disposed within the at least one hole; and wherein the sides, the first end, and the second end have rails formed by folding edges of the elongated mat upwardly while remaining interconnected to the mat by the male prongs and female slots.

* * * * *